US006021828A

United States Patent [19]

Snair

[11] Patent Number: 6,021,828

[45] Date of Patent: Feb. 8, 2000

[54] TRIM SAW WITH WASTE REMOVAL BLADES

[75] Inventor: Denton C. Snair, Stockbridge, Ga.

[73] Assignee: Cut Rite Corporation, Stockbridge, Ga.

[21] Appl. No.: 09/294,187

[22] Filed: Apr. 19, 1999

[51] Int. Cl.[7] ..... B27G 13/00; B27B 33/00

[52] U.S. Cl. ..... 144/237; 144/222; 144/238; 144/218; 83/837

[58] Field of Search ..... 83/664, 676, 838, 83/877; 144/218, 222, 236, 237, 238, 223, 239; 407/31

[56] References Cited

U.S. PATENT DOCUMENTS 682,810 9/1901 Parks ..... 144/238
1,545,293 7/1925 Ware ..... 144/222
4,589,458 5/1986 McCord, Jr. ..... 144/238
5,309,962 5/1994 McCord, Jr. et al. ..... 144/238

*Primary Examiner*—W. Donald Bray
*Attorney, Agent, or Firm*—James B. Middleton

[57] ABSTRACT

A trim saw is mounted in conjunction with a hogger, or device for reducing scrap to particles, or saw dust. The hogger is made up of a any desired number of units that will reduce scrap to sawdust. Each unit has a pair of oscillator plates that hold a pair of semicircular blade portions at an angle to the axis of rotation, so the blade portions sweep a wide kerf. Since the blades are generally conventional saw blades, they can be sharpened by conventional machines, obviating the need for hand sharpening. Also, the relatively fine teeth on the hogger blades allows substantially uniform power loading for uniform operation.

5 Claims, 1 Drawing Sheet

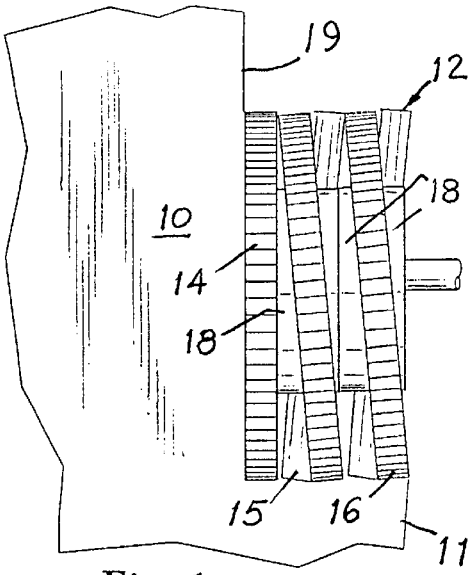
Fig. 1
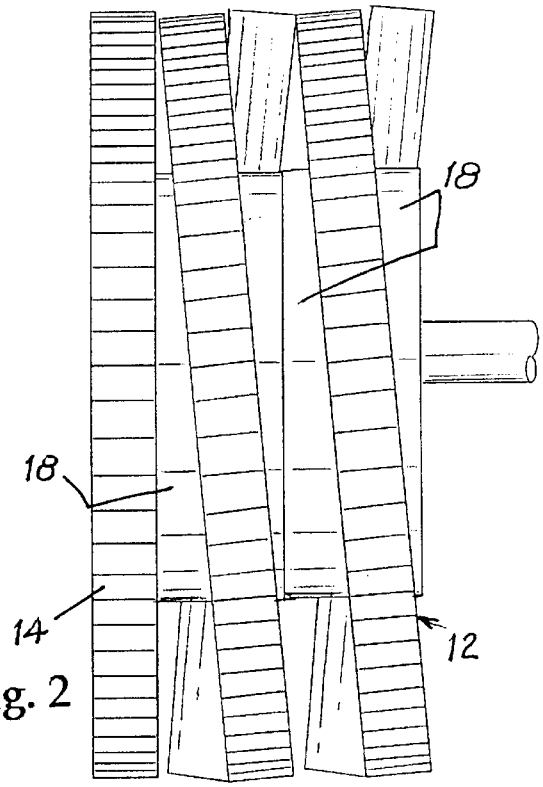
Fig. 2
Fig. 4
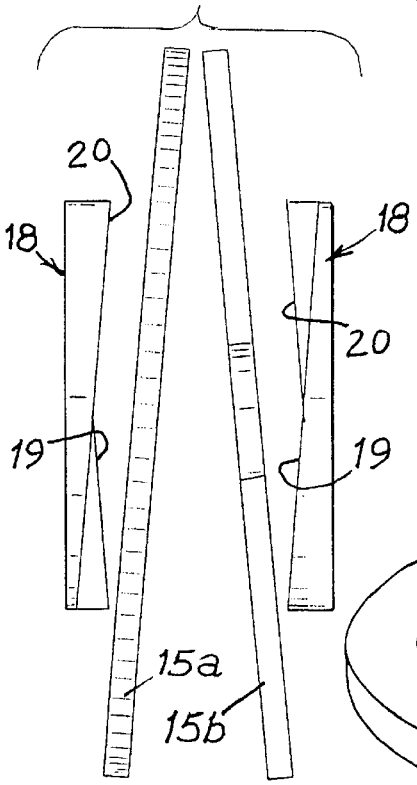
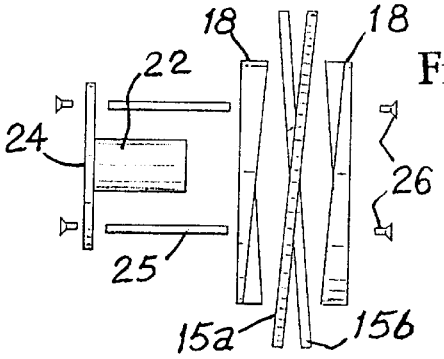
Fig. 5
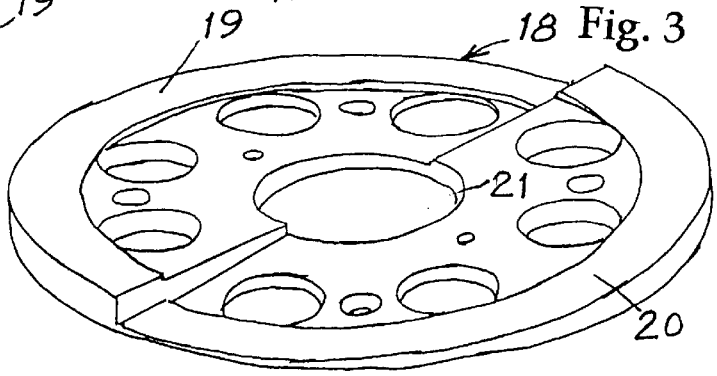
Fig. 3

TRIM SAW WITH WASTE REMOVAL BLADES

BACKGROUND OF THE INVENTION

1. Field of the Invention

This invention relates generally to the trimming of edges of sheets, and is more particularly concerned with the simultaneous trimming of a sheet and reduction of the waste to sawdust.

2. Discussion of the Prior Art

In the manufacture of particleboard and the like, the board is initially made as sheets with uneven edges. Subsequently, the edges of the sheets are sawn to yield a straight, clean edge. During the sawing, one generally utilizes some chipping means so the waste being removed is reduced to small chips, or sawdust.

While it is well known to mount a chipping means adjacent to a trim saw, the chipping means is truly a chipper, and must be maintained as a separate piece of equipment. The installation and adjustment of the chipping means are difficult and time consuming, especially in that sharpening and adjustment must be accomplished by hand. Examples of such chipping means are shown in U.S. Pat. No. 3,780,778 to Chapman and U.S. Pat. No. 4,266,584 to Lownicki.

The prior art chipping means typically utilizes intermittent cutting means for engaging the scrap and reducing it to chips, or sawdust. Due to the intermittent nature, more power is required when a chipper blade does engage the material because there is a large quantity of waste material. Waste removal is therefore rather rough in action, creating erratic loading on the driving means and non-uniform chipping action.

SUMMARY OF THE INVENTION

The present invention provides a trim saw having waste removal means adjacent thereto for simultaneous operation therewith. The waste removal means comprises at least one oscillating saw blade, the saw blade being mounted at an angle to the drive shaft so the oscillating blade sweeps a wide kerf. Thus, the oscillating saw blade effects chipping as smoothly as the trim saw blade cuts through the sheet of material, and the power loading is substantially constant. The oscillating blades produce a fan-like action that tends to blow dust away from the unit, and reduce wear of the parts by dust. Furthermore, each oscillating saw blade incorporates two semicircular blade portions that are angled oppositely to each other, and oscillator plates hold the blade portions in position. A plurality of oscillator plates and oscillating saw blades can make up the desired waste removal means.

BRIEF DESCRIPTION OF THE DRAWINGS

These and other features and advantages of the present invention will become apparent from consideration of the following specification when taken in conjunction with the accompanying drawings in which:

FIG. 1 is a top plan view of an apparatus made in accordance with the present invention, the apparatus being shown trimming the edge of a piece of sheet material such as particle board or the like;

FIG. 2 is an enlarged top plan view of the apparatus shown in FIG. 1;

FIG. 3 is an enlarged, perspective view showing one of the oscillator plates utilized in the device shown in FIGS. 1 and 2;

FIG. 4 is an exploded, front elevational view showing one assembly of oscillator plates and semicircular blade portions; and, FIG. 5 is a view similar to FIG. 4, but on a reduced scale and showing means for holding the assembly together.

DETAILED DESCRIPTION OF THE DRAWINGS

Referring now more particularly to the drawings, and to that embodiment of the invention here chosen by way of illustration, FIG. 1 shows a sheet 10 of particle board or other material that has a rough, or uneven, edge 11 that needs to be dressed, e.g. by sawing. An apparatus made according to the present invention is shown at 12 and includes a trim saw 14 with oscillating saws 15 and 16 adjacent thereto. The oscillating saws 15 and 16 are mounted in the positions shown, and held, by a plurality of oscillator plates 18.

It will be readily understood by those skilled in the art that, as the device 12 is moved along the sheet 10, the trim saw 14 will provide a smoothly cut, straight edge 19. As the trim saw 14 cuts its kerf, the oscillating saw blades 15 and 16 will sweep back and forth to chip the waste and reduce the waste to saw dust.

Looking at FIG. 2 of the drawings, it can be seen more easily that the device 12 comprises one generally conventional saw blade 14 and two sets of semicircular blades, indicated at 15 and 16, mounted to oscillate. It will be noticed that, in each pair of semicircular blades, one blade portion 15*a* is angled in one direction, and a complementary blade portion 15*b* is angled in the opposite direction.

To achieve the peculiar mounting of the semicircular blade portions, a plurality of oscillator plates 18 is used, and one such plate 18 is shown in detail in FIG. 3 of the drawings. The bottom (as pictured) side of the oscillator plate 18 is generally flat, while the top side has two angled face portions 19 and 20 which are angled with respect to the bottom side of the plate. The oscillator plate 18 also has a central hole 21 for receiving a shaft, as well be described hereinafter. Other holes in the oscillator plate 18 reduce the weight of the piece, and provide holes for holding the assembly together.

With the above in mind, attention is directed to FIG. 4 of the drawings. Here it can be seen that a pair of oscillator plates 18 is placed with the angled face portions towards each other, so the angled face portions may also be referred to as the inside of the oscillator plates. Between the two oscillator plates there are two semicircular blade portions 15*a* and 15*b*. Though the blade portions 15*a* and 15*b* are shown side by side, it will be understood that the portion 15*b* is rearwardly of the portion 15*a*. Thus, the blade portion 15*a* is parallel to the angled face portions 20, and the blade portion 15*b* is parallel to the face portion 19. When the oscillator plates 18 are placed together, the blade portions 15*a* and 15*b* will be clamped between the plates, the blade portions forming an X as viewed in FIG. 5.

The combination of the two oscillator plates 18 and two blade portions 15*a* and 15*b* makes up a waste removal unit; and, a plurality of such units can be assembled to cover any width desired. FIGS. 1 and 2, for example, show two such units side-by-side, and additional units can be added up to any reasonable width that one might support mechanically.

For holding the waste removal device together, one might use structure as shown in FIG. 5 of the drawings. FIG. 5 shows only one waste removal unit, which comprises blade portions 15*a* and 15*b* and two oscillator plates 18. A hub 22 is sized to pass through the central holes 21 in the oscillator plates 18, and a flange 24 fixed to one end of the hub 22 receives the trim saw blade 14. A plurality of tubular members 25 pass through holes in the oscillator plates 18, and through holes in the blade portions 15*a* and 15*b*. Screws 26 threadedly engage each end of the tubular members 25 to secure the assembly.

With the above and foregoing description in mind, it will be understood that the present invention provides a trim saw with waste removal, the device being simple to construct and maintain. Since generally conventional circular saws are used, the saws are easy to maintain and to sharpen on conventional apparatus rather than requiring hand sharpening. Further, the use of relatively fine-toothed blades causes the waste to be reduced to small particles with substantially uniform loading on the drive train.

The use of semicircular blade portions allows the use of generally conventional blades, but prevents the entrapment of sawdust between adjacent blades. Since the blade portions are angled oppositely, there is a very small area wherein adjacent blades are close, so saw dust is generally removed by the normal air movement in the vicinity. Also, of course, if a few teeth on a blade are damaged, only half a blade must be replaced instead of a whole blade.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

What is claimed as invention is:

1. In the combination of a trim saw with waste removal means adjacent thereto, said trim saw being mounted for rotation about an axis and being perpendicular to said axis, and said waste removal means being mounted for rotation with said trim saw and arranged to chip the scrap from said trim saw, the improvement wherein said waste removal means comprises at least one oscillator plates having a first side parallel to said trim saw and mounted coaxially with said trim saw, a second side having a plurality of angled face portions angled with respect to said first side, a plurality of blade portions, each blade portion of said plurality of blade portions being fixed to one face portion of said plurality of face portions, so that said blade portions wobble as they rotate with said oscillator plate.

2. The combination of claim 1, wherein said plurality of face portions comprises two face portions, and said plurality of blade portions comprises two semicircular blade portions, said two face portions being angled oppositely from each other.

3. Waste removal means for use with a trim saw, wherein said trim saw is mounted for rotation about an axis and is perpendicular to said axis, said waste removal means being mounted for rotation with said trim saw about said axis, said waste removal means comprising at least one oscillator plate, and a plurality of blade portions fixed to said oscillator plate, said oscillator plate having a first side parallel to said trim saw, and a second side having a pair of angled face portions, said face portions of said pair of face portions being angled oppositely from each other so the said blade portions are angled oppositely from each other.

4. Waste removal means as claimed in claim 3, wherein said at least one oscillator plate comprises a pair of oscillator plates, one oscillator plate of said pair of oscillator plates being on each side of said blade portions for forming a waste removal unit.

5. Waste removal means as claimed in claim 4, wherein said waste removal means comprises a plurality of said waste removal units rotatable about said axis.

* * * * *